US008763170B1

(12) United States Patent
Ungarsohn

(10) Patent No.: US 8,763,170 B1
(45) Date of Patent: Jul. 1, 2014

(54) SINK STRAINER SCRAPER APPARATUS FOR DISLODGING RESIDUAL SOLID DEBRIS THEREFROM

(76) Inventor: Benjamin I Ungarsohn, Bellmore, NY (US)

( * ) Notice: Subject to any disclaimer, the term of this patent is extended or adjusted under 35 U.S.C. 154(b) by 548 days.

(21) Appl. No.: 13/135,634

(22) Filed: Jul. 11, 2011

(51) Int. Cl.
*E03C 1/26* (2006.01)

(52) U.S. Cl.
USPC ..... 4/292

(58) Field of Classification Search
CPC ..... E03C 1/00
USPC ..... 4/286–295; 427/197; 118/504
See application file for complete search history.

(56) References Cited

U.S. PATENT DOCUMENTS

| | | | | | |
|---|---|---|---|---|---|
| 152,571 | A | | 6/1874 | Miller | |
| 2,107,126 | A | | 2/1938 | Pasman | |
| 2,285,833 | A | | 6/1942 | Platt | |
| 3,383,715 | A | | 5/1968 | Young | |
| 3,525,105 | A | | 8/1970 | Richards | |
| 3,662,425 | A | | 5/1972 | Klein et al. | |
| 3,711,874 | A | * | 1/1973 | Gajer | 4/287 |
| 5,367,775 | A | * | 11/1994 | Tong et al. | 30/324 |
| 5,377,362 | A | * | 1/1995 | Jackson | 4/292 |
| 5,458,054 | A | * | 10/1995 | Yu | 99/446 |
| 6,047,432 | A | * | 4/2000 | Sode | 15/160 |
| 6,108,828 | A | * | 8/2000 | Cheng | 4/287 |
| 7,185,766 | B2 | * | 3/2007 | Cooper | 210/533 |
| 7,299,519 | B1 | * | 11/2007 | Garry | 15/104.05 |
| 7,367,078 | B2 | * | 5/2008 | Mameletzi et al. | 15/105 |
| 7,430,779 | B1 | * | 10/2008 | Garry | 15/104.05 |
| 7,690,523 | B2 | * | 4/2010 | Harris | 220/23.89 |
| 7,866,336 | B1 | | 1/2011 | Gutierrez | |
| D677,522 | S | * | 3/2013 | Renner | D7/391 |
| 2001/0054358 | A1 | * | 12/2001 | Rigney | 99/403 |
| 2003/0182721 | A1 | | 10/2003 | Li | |
| 2005/0230326 | A1 | * | 10/2005 | Cooper | 210/776 |
| 2006/0175247 | A1 | * | 8/2006 | Cooper | 210/470 |
| 2006/0254976 | A1 | * | 11/2006 | Cooper | 210/470 |
| 2008/0105697 | A1 | * | 5/2008 | Harris | 220/735 |
| 2013/0156944 | A1 | * | 6/2013 | Miller | 427/197 |

* cited by examiner

*Primary Examiner* — Lori Baker
(74) *Attorney, Agent, or Firm* — Richard L. Miller

(57) ABSTRACT

A strainer for fitting in a drain of a sink and for being self-cleaning of residual solid debris sticking to the strainer without a user having to touch the residual solid debris, shake the strainer, or hit the strainer against an object. The strainer includes a bowl, a handle, a stopper, and a scraper arm. The bowl fits snugly within the drain of the sink, and is perforated to permit fluid to pass therethrough, while collecting the residual solid debris. The handle is movably mounted through the bowl to manually remove the strainer from the drain of the sink. The stopper is rotatably connected to the handle, is disposed below the bowl, and sits in the drain of the sink. The scraper arm is affixed to, and rotates with, the handle. When the handle is rotated by hand manipulation, the scraper arm sweeps along the bowl self-cleaning the residual solid debris sticking to the bowl without a user having to touch the residual solid debris, shake the strainer, or hit the strainer against the object.

54 Claims, 10 Drawing Sheets

SINK STRAINER SCRAPER APPARATUS FOR DISLODGING RESIDUAL SOLID DEBRIS THEREFROM

1. BACKGROUND OF THE INVENTION

A. Field of the Invention

The embodiments of the present invention relate to a strainer for fitting in a drain of a sink, and more particularly, the embodiments of the present invention relate to a strainer for fitting in a drain of a sink and for being self-cleaning of residual solid debris sticking to the strainer without a user having to touch the residual solid debris, shake the strainer, or hit the strainer against an object.

B. Description of the Prior Art

Numerous innovations for sink strainers have been provided in the prior art, which will be described below in chronological order to show advancement in the art, and which are incorporated herein by reference thereto. Even though these innovations may be suitable for the specific individual purposes to which they address, nevertheless, they differ from the embodiments of the present invention in that they do not teach a strainer for fitting in a drain of a sink and for being self-cleaning of residual solid debris sticking to the strainer without a user having to touch the residual solid debris, shake the strainer, or hit the strainer against an object.

(1) U.S. Pat. No. 152,571 to Miller.

U.S. Pat. No. 152,571—issued to Miller on Jun. 30, 1874—teaches a sink-trap including a bowl having lugs with pendent pins. The cup is centrally located thereunder. A flaring tube has lugs with pendent pins. The flaring tube has perforated lugs.

(2) U.S. Pat. No. 2,107,126 to Pasman.

U.S. Pat. No. 2,107,126—issued to Pasman on Feb. 1, 1938 in U.S. class 4 and subclass 291—teaches a strainer for a sink or the like including a cylindrical cup-shaped body having a flat perforated bottom, a corrugated and perforated circumferential wall, and a handle attached to the bottom for removal of the strainer from the sink. The perforations in the circumferential wall are located only in the depressed portions of the corrugations.

(3) U.S. Pat. No. 2,285,833 to Platt.

U.S. Pat. No. 2,285,833—issued to Platt on Jun. 9, 1942 in U.S. class 210 and subclass 170—teaches a strainer for a waste drain fitting, which includes a tapered cup-shaped member smaller at the bottom than at the top and made of foldable paper-like material adapted to absorb and retain perfume or disinfectant. The member is perforated to permit fluid to pass therethrough, but to collect waste solid material. The member has a tab struck up from the body thereof and extends upwardly from its upper open edge to facilitate handling thereof. The strainer is shaped to snugly fit within the upper edge of the waste drain.

(4) U.S. Pat. No. 3,383,715 to Young.

U.S. Pat. No. 3,383,715—issued to Young on May 21, 1968 in U.S. class 4 and subclass 288—teaches a sink strainer assembly including a flanged strainer body having a plurality of affixed threaded depending studs around the lower neck of the body to which are secured by wing nuts both a flanged retainer cup fitting around the body and a tailpiece retainer plate.

(5) U.S. Pat. No. 3,525,105 to Richards.

U.S. Pat. No. 3,525,105—issued to Richards on Aug. 25, 1970 in U.S. class 4 and subclass 287—teaches a sink strainer including a stem formed of plate spring steel, which has a portion of larger diameter than a slot in the sink base. Contact between this portion of the stem and the edge of the slot provides the raised position. The sink strainer seals with the sink base by forcing the stem through the slot. The stem is tapered inwardly above the portion of larger diameter so that the sideways pressure exerted by the edge of the slot on the tapered portion forces it downwardly to accentuate the sealing position.

(6) U.S. Pat. No. 3,662,425 to Klein et al.

U.S. Pat. No. 3,662,425—issued to Klein et al. on May 16, 1972 in U.S. class 15 and subclass 245—teaches a scrap block for use with commercial food service equipment. An upstanding lip extends inwardly along a portion of the upper edge of the block to allow rapid removal of jelled liquids and food particles from dishware. The lower engagement wall has a circular bead detent around its outer surface to insure that the block will not be knocked out of position. The block has an annular skirt covering the receiving hole preventing drippings getting therein.

(7) U.S. Pat. No. 5,377,362 to Jackson.

U.S. Pat. No. 5,377,362—issued to Jackson on Jan. 3, 1995 in U.S. class 4 and subclass 292—teaches a combined sink strainer and scrub brush unit with or without a sink stopper disc is provided which seats into a garbage disposal inlet depending from a sink bottom. A horizontal strainer base has a series of drain apertures therein and a series of spaced brush elements either molded with the base or attached to the base and depending from the base. A handle is attached to the base for manual removal of the unit from the disposal inlet and for hand-manipulating the unit to scrape/scrub foodstuff and other debris from dish plates, cooking pots, and sink surfaces into the sink and disposal inlet. A rubber stopper disc is mounted on top of base for rotational and sliding movement thereon. Radial drain holes in the disc are alignable with the base drain apertures in a drain "open" position and are offset therefrom in a drain "closed" sealing position.

(8) United States Patent Application Publication Number 2003/0182721 to Li.

United States Patent Application Publication Number 2003/0182721—published to Li on Oct. 2, 2003 in U.S. class 4 and subclass 287—teaches a sink stopper assembly that includes cup and basket strainers. The cup strainer includes a bottom wall having a positioning hole and a shoulder portion forming a seat member. The basket strainer is disposed in the cup strainer and includes a receiving space, a handle extending upwardly from a base wall, a sealing ring to be seated against the seat member, and a retaining stem extending downwardly from the base wall to penetrate the positioning hole. The retaining stem includes a bent metal plate that has two opposite elastic arms, at least one upper protrusion, at least one lower protrusion, and a recess defined between the upper and lower protrusions.

It is apparent that numerous innovations for sink strainers have been provided in the prior art, which are adapted to be used. Furthermore; even though these innovations may be suitable for the specific individual purposes to which they address, nevertheless, they would not be suitable for the purposes of the embodiments of the present invention as heretofore described, namely, a strainer for fitting in a drain of a sink and for being self-cleaning of residual solid debris sticking to the strainer without a user having to touch the residual solid debris, shake the strainer, or hit the strainer against an object.

2. SUMMARY OF THE INVENTION

Thus, an object of the embodiments of the present invention is to provide a strainer for fitting in a drain of a sink and for being self-cleaning of residual solid debris sticking to the strainer without a user having to touch the residual solid debris, shake the strainer, or hit the strainer against an object, which avoids the disadvantages of the prior art.

Briefly stated, another object of the embodiments of the present invention is to provide a strainer for fitting in a drain of a sink and for being self-cleaning of residual solid debris sticking to the strainer without a user having to touch the residual solid debris, shake the strainer, or hit the strainer against an object. The strainer includes a bowl, a handle, a stopper, and a scraper arm. The bowl fits snugly within the drain of the sink, and is perforated to permit fluid to pass therethrough, while collecting the residual solid debris. The handle is movably mounted through the bowl to manually remove the strainer from the drain of the sink. The stopper is rotatably connected to the handle, is disposed below the bowl, and sits in the drain of the sink. The scraper arm is affixed to, and rotates with, the handle. When the handle is rotated by hand manipulation, the scraper arm sweeps along the bowl self-cleaning the residual solid debris sticking to the bowl without a user having to touch the residual solid debris, shake the strainer, or hit the strainer against the object.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

4. LIST OF REFERENCE NUMERALS UTILIZED IN THE FIGURES OF THE DRAWING

Figure 1:
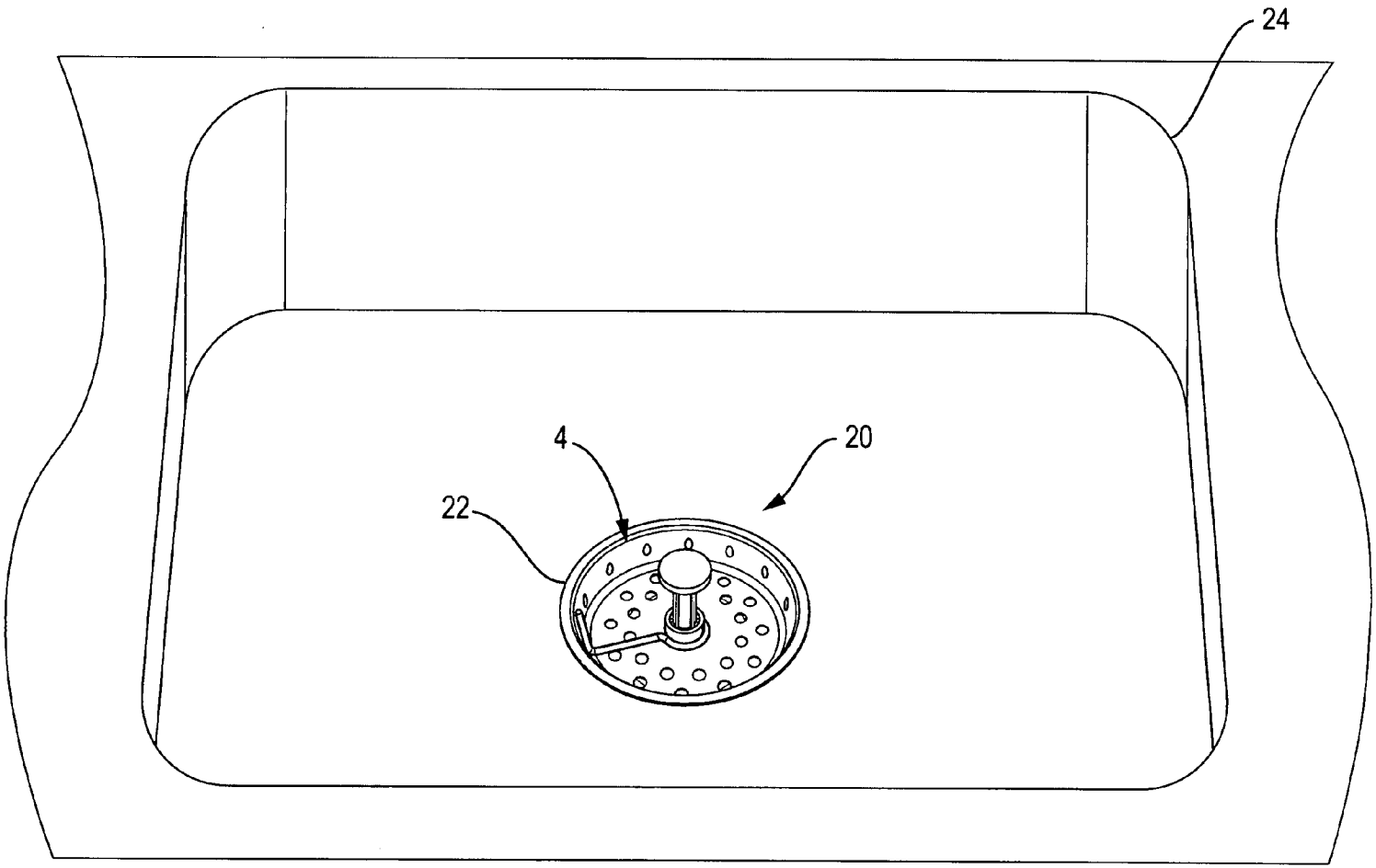
FIG. 1 is a diagrammatic perspective view of the strainer of the embodiments of the present invention fitting in a drain of a sink and self-cleaning of residual solid debris sticking to the strainer without a user having to touch the residual solid debris, shake the strainer, or hit the strainer against an object.

A. General.

20 strainer of embodiments of present invention for fitting in drain 22 of sink 24 and for being self-cleaning of residual solid debris 26 sticking to strainer 20 without user 27 having to touch the residual solid debris 26, shake strainer, 20 or hit strainer 20 against object

22 drain of sink 24

24 sink

26 residual solid debris

27 user

B. Overall Configuration of Strainer 20.

28 bowl for fitting snugly within drain 22 of sink 24

30 handle for manual removal of strainer 20 from drain 22 of sink 24

32 stopper for sitting in drain 22 of sink 24

34 scraper arm for self-cleaning of residual solid debris 26 sticking on bowl 28 without user 27 having to touch residual solid debris 26, shake strainer 20, or hit strainer 20 against an object C. Specific Configuration of Bowl 28.

35 floor of bowl 28 for permitting fluid to pass therethrough, while collecting residual solid debris 26.

36 circumferential side wall of bowl 28 for permitting fluid to pass therethrough, while collecting residual solid debris 26

38 flange of bowl 28

39 central through bore through floor 35 of bowl 28

40 terminal rim of circumferential side wall 36 of bowl 28

D. Specific Configuration of Handle 30 and Stopper 32.

41 stem of handle 30

42 collar of handle 30

44 upper portion of stem 41 of handle 30

46 lower portion of stem 41 of handle 30

48 crown of upper portion 44 of stem 41 of handle 30 for facilitating gripping of handle 30 by user 27

50 splines of upper portion 44 of stem 41 of handle 30

52 internal recesses in collar 42 of handle 30

54 central through bore in stopper 32

56 pointed termination of lower portion 46 of stem 41 of handle 30

58 thinned termination of lower portion 46 of stem 41 of handle 30 for providing user 27 with grip when rotating handle 30

E. Specific Configuration of Scraper Arm 34.

60 proximal portion of scraper arm 34

62 intermediate portion of scraper arm 34

64 distal portion of scraper arm 34

66 bend of scraper arm 34

5. DETAILED DESCRIPTION OF THE PREFERRED EMBODIMENTS

A. General.

Figure 2:
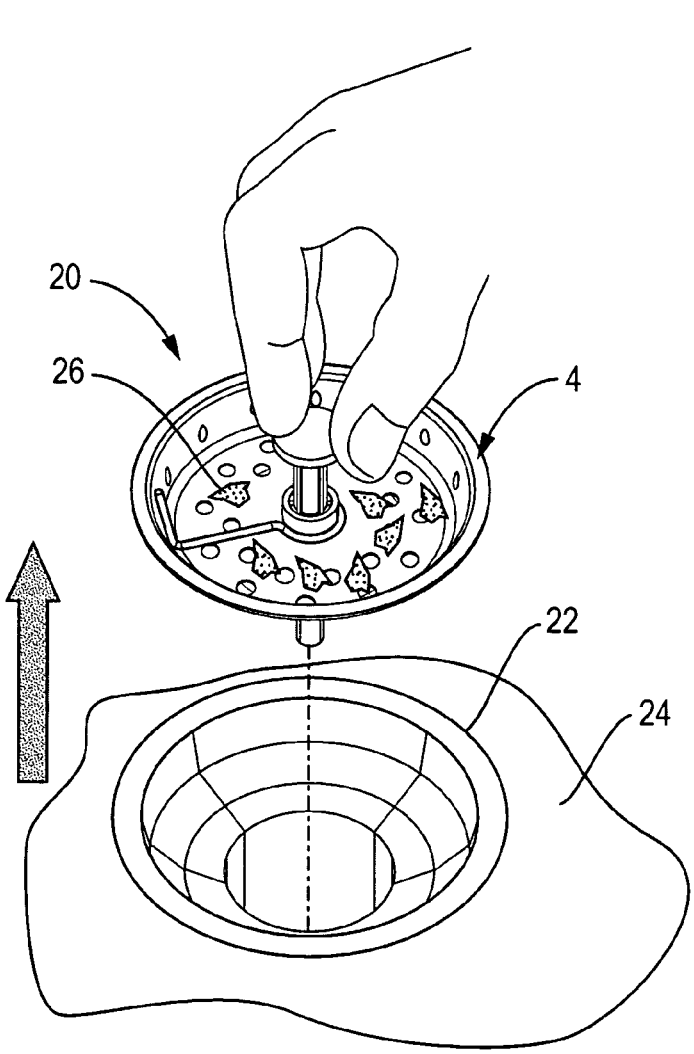
FIG. 2 is an exploded diagrammatic perspective view of the strainer of the embodiments of the present invention shown in FIG. 1 being removed from a drain of a sink.
Figure 3:
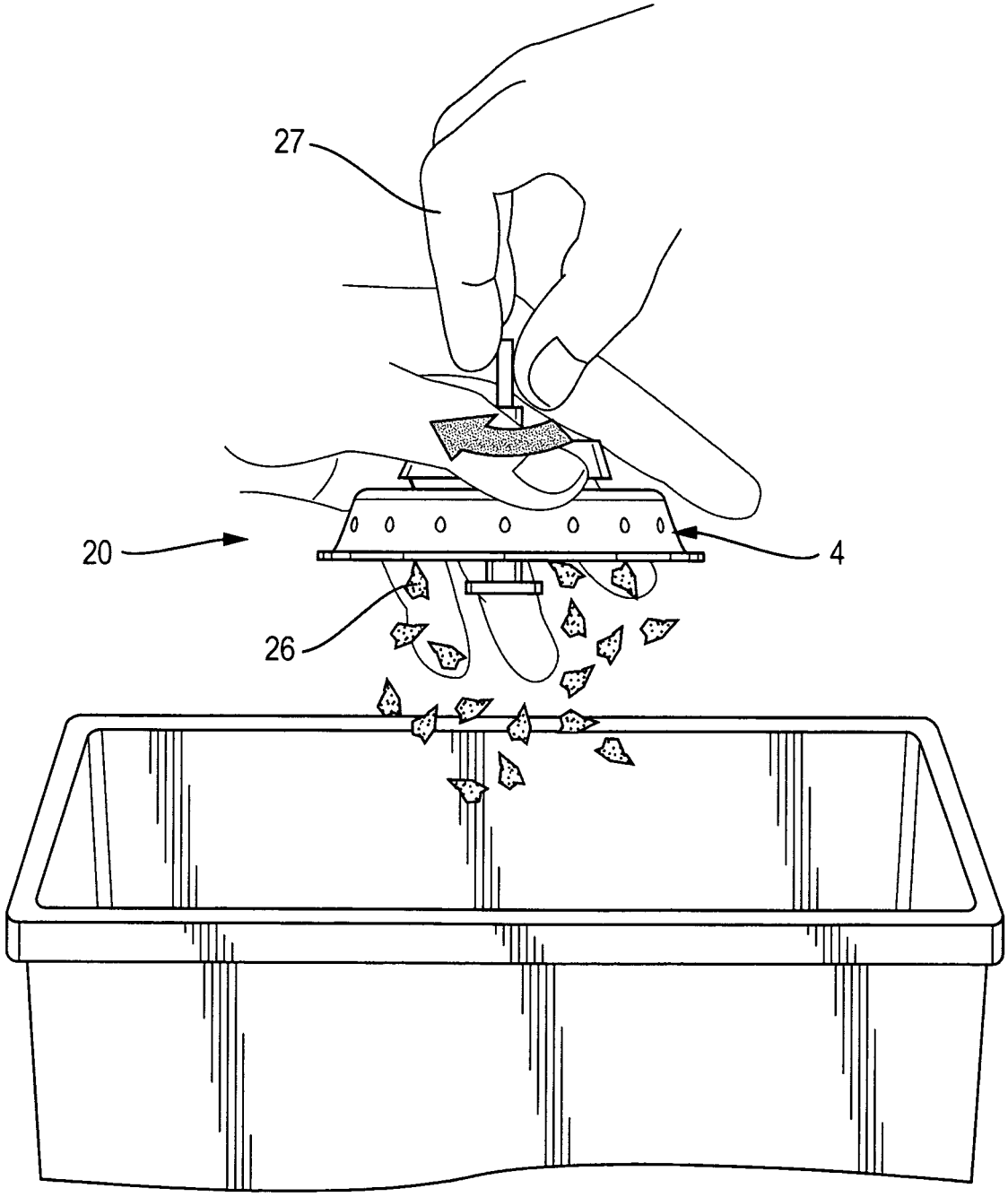
FIG. 3 is a diagrammatic perspective view of the strainer of the embodiments of the present invention shown in FIG. 1 being self-cleaning of residual solid debris sticking to the strainer without a user having to touch the residual solid debris, shake the strainer, or hit the strainer against an object.

Referring now to the figures, in which like numerals indicate like parts, and particularly to FIGS. 1-3, which are, respectively, a diagrammatic perspective view of the strainer of the embodiments of the present invention fitting in a drain of a sink and self-cleaning of residual solid debris sticking to the strainer without a user having to touch the residual solid debris, shake the strainer, or hit the strainer against an object, an exploded diagrammatic perspective view of the strainer of the embodiments of the present invention shown in FIG. 1 being removed from a drain of a sink, and a diagrammatic perspective view of the strainer of the embodiments of the present invention shown in FIG. 1 being self-cleaning of residual solid debris sticking to the strainer without a user having to touch the residual solid debris, shake the strainer, or hit the strainer against an object, the strainer of the embodiments of the present invention is shown generally at 20 for fitting in a drain 22 of a sink 24 and for being self-cleaning of residual solid debris 26 sticking to the strainer 20 without a user 27 having to touch the residual solid debris 26, shake the strainer 20, or hit the strainer 20 against an object.

B. Overall Configuration of the Strainer 20.

The overall configuration of the strainer 20 can best be seen in FIG. 4, which is an enlarged diagrammatic perspective view of the strainer of the embodiments of the present invention identified by ARROW 4 in FIGS. 1-3, and as such, will be discussed with reference thereto.

The strainer 20 comprises a bowl 28, a handle 30, a stopper 32, and a scraper arm 34.

The bowl 28 is for fitting snugly within the drain 22 of the sink 24, and is perforated for permitting fluid to pass therethrough, while collecting the residual solid debris 26.

The handle 30 is movably mounted through the bowl 28 for manual removal of the strainer 20 from the drain 22 of the sink 24.

The stopper 32 is rotatably connected to the handle 30, below the bowl 28, and is for sitting in the drain 22 of the sink 24.

The scraper arm 34 is affixed to, and rotates with, the handle 30, and when the handle 30 is rotated by hand manipulation, the scraper arm 34 sweeps along the bowl 28 self-cleaning the residual solid debris 26 sticking to the bowl 28 without a user 27 having to touch the residual solid debris 26, shake the strainer 20, or hit the strainer 20 against the object.

C. Specific Configuration of the Bowl 28.

The bowl 28 is cylindrically shaped, and has a floor 35, a circumferential side wall 36, and a flange 38.

The floor 35 of the bowl 28 is flat, circular shaped, perforated for permitting fluid to pass therethrough, while collecting the residual solid debris 26, and has a central through bore 39.

The circumferential side wall 36 of the bowl 28 extends divergently upwardly from the floor 35 of the bowl 28 to a terminal rim 40, and is perforated for permitting fluid to pass therethrough, while collecting the residual solid debris 26.

The flange 38 of the bowl 28 extends radially outwardly from the terminal rim 40 of the circumferential side wall 36 of the bowl 28.

D. Specific Configuration of the Handle 30 and the Stopper 32.

Figure 4:
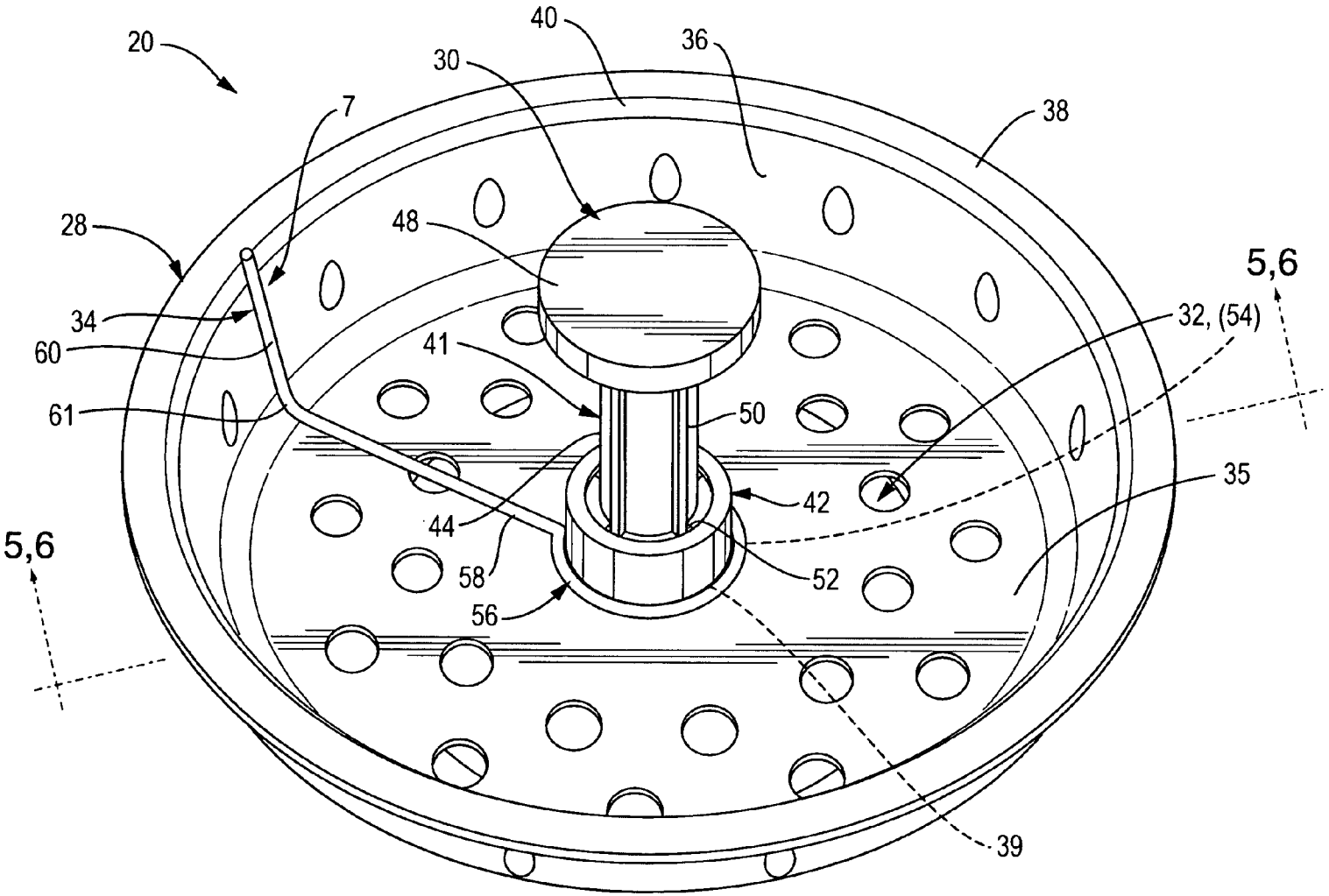
FIG. 4 is an enlarged diagrammatic perspective view of the strainer of the embodiments of the present invention identified by ARROW 4 in FIGS. 1-3.
Figure 5:
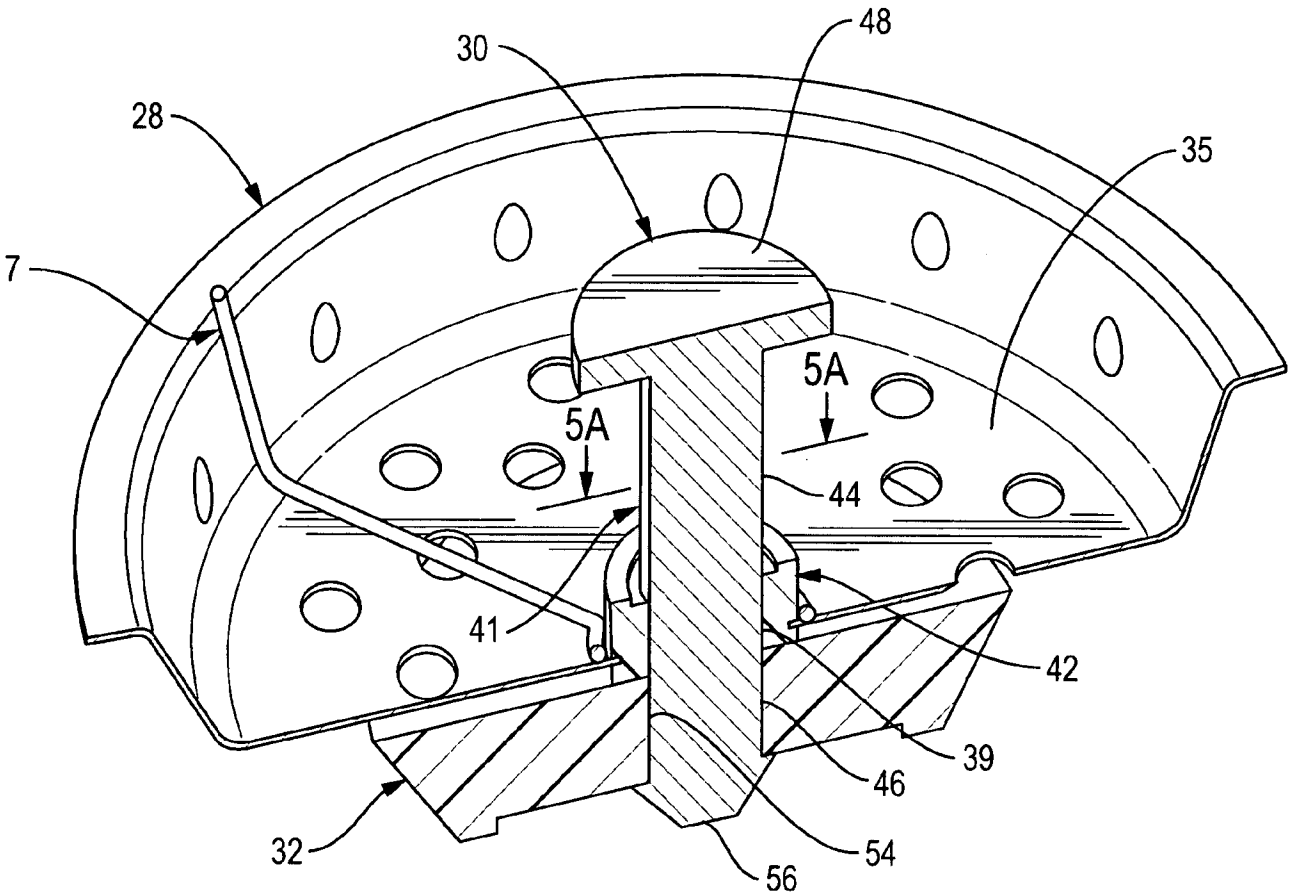
FIG. 5 is a diagrammatic cross sectional view taken along LINE 5-5 in FIG. 4.
Figures 5A, 6A:
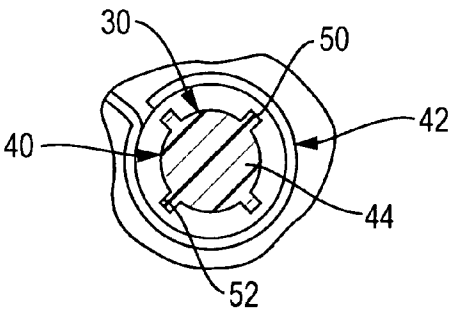
FIG. 5A is a diagrammatic cross sectional view taken along LINE 5A-5A in FIG. 5.
FIG. 6A is a diagrammatic cross sectional view taken along LINE 6A-6A in FIG. 6.
Figure 6:
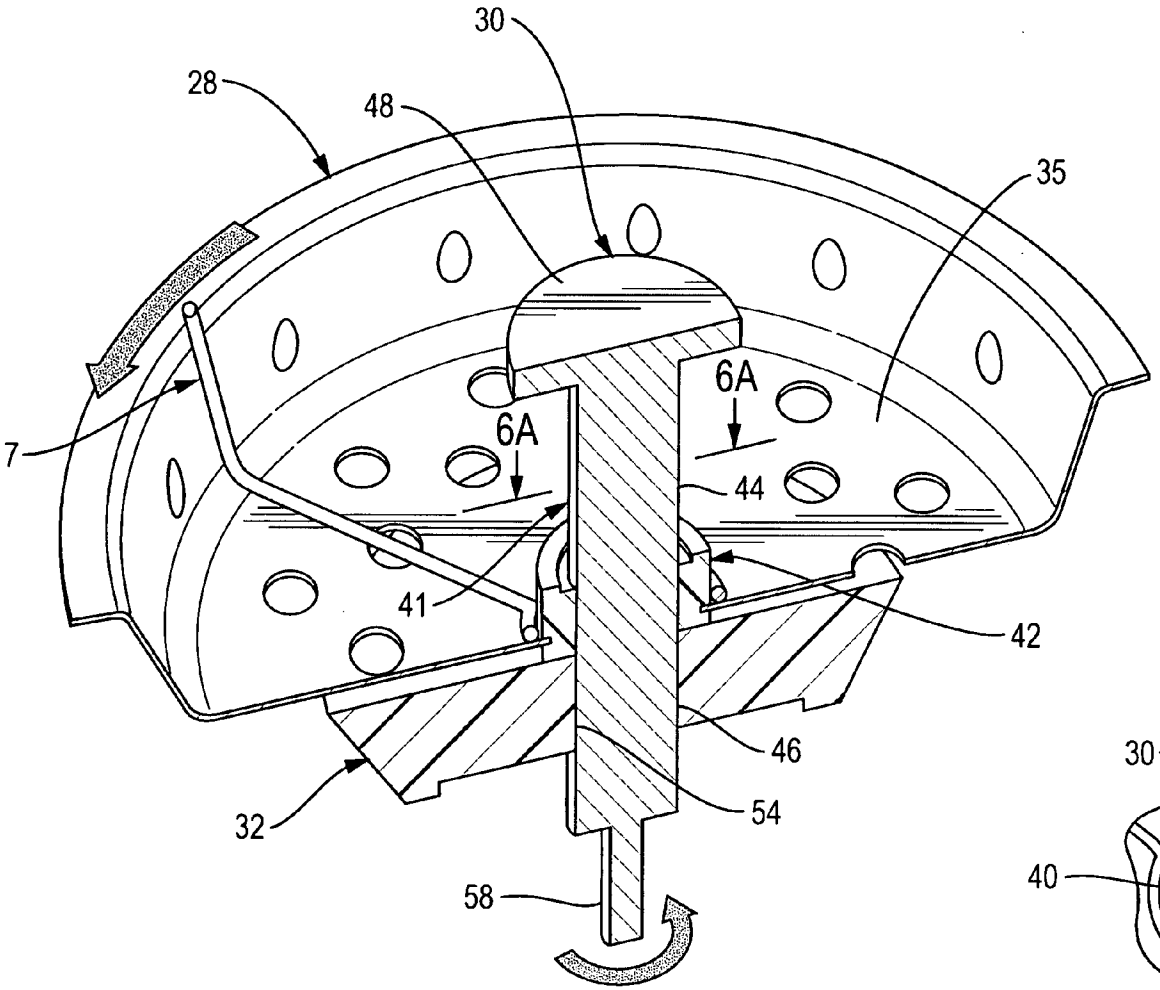
FIG. 6 is a diagrammatic cross sectional view taken along LINE 6-6 in FIG. 4.

The specific configuration of the handle 30 and the stopper 32 can best be seen in FIGS. 4, 5, 5A, 6, and 6A, which are, respectively, again an enlarged diagrammatic perspective view of the strainer of the embodiments of the present invention identified by ARROW 4 in FIGS. 1-3, a diagrammatic cross sectional view taken along LINE 5-5 in FIG. 4, a diagrammatic cross sectional view taken along LINE 5A-5A in FIG. 5, a diagrammatic cross sectional view taken along LINE 6-6 in FIG. 4, and a diagrammatic cross sectional view taken along LINE 6A-6A in FIG. 6, and as such, will be discussed with reference thereto.

The handle 30 comprises a stem 41 and a collar 42.

The collar 42 of the handle 30 is rotatably seated in the central through bore 39 in the floor 35 of the bowl 28

The stem 41 of the handle 30 is operatively connected to the collar 42 of the handle 30, and has an upper portion 44 and a lower portion 46.

The upper portion 44 of the stem 41 of the handle 30 is disposed above the floor 35 of the bowl 28, while the lower portion 46 of the stem 41 of the handle 30 is disposed below the floor 35 of the bowl 28.

The upper portion 44 of the stem 41 of the handle 30 has a crown. The crown 48 of the upper portion 44 of the stem 41 of the handle 30 is wider than the stem 41 of the handle 30 for facilitating gripping of the handle 30 by the user 27.

The upper portion 44 of the stem 41 of the handle 30 further has splines 50. The splines 50 of the upper portion 44 of the stem 41 of the handle 30 extend axially therealong.

The collar 42 of the handle 30 contains internal recesses 52. The internal recesses 52 in the collar 42 of the handle 30 extend axially therealong, and selectively receive the splines 50 of the upper portion 44 of the stem 41 of the handle 30, and when the internal recesses 52 in the collar 42 of the handle 30 cooperatively receive the splines 50 of the upper portion 44 of the stem 41 of the handle 30, the collar 42 of the handle 30 rotates with the upper portion 44 of the stem 41 of the handle 30 when the stem 41 of the handle 30 is rotated by the user 27.

The stopper 32 is truncated conically shaped, made of rubber, and has a central through bore 54. The central through bore 54 in the stopper 32 receives the lower portion 46 of the stem 41 of the handle 30.

As shown in FIG. 5, the lower portion 46 of the stem 41 of the handle 30 terminates minimally past the stopper 32, at a pointed termination 56.

As shown in FIG. 6, the lower portion 46 of the stem 41 of the handle 30 depends a distance below the stopper 32, at a thinned termination 58, for providing the user 27 with a grip to rotate the handle 30.

E. Specific Configuration of the Scraper Arm 34.

Figure 7:
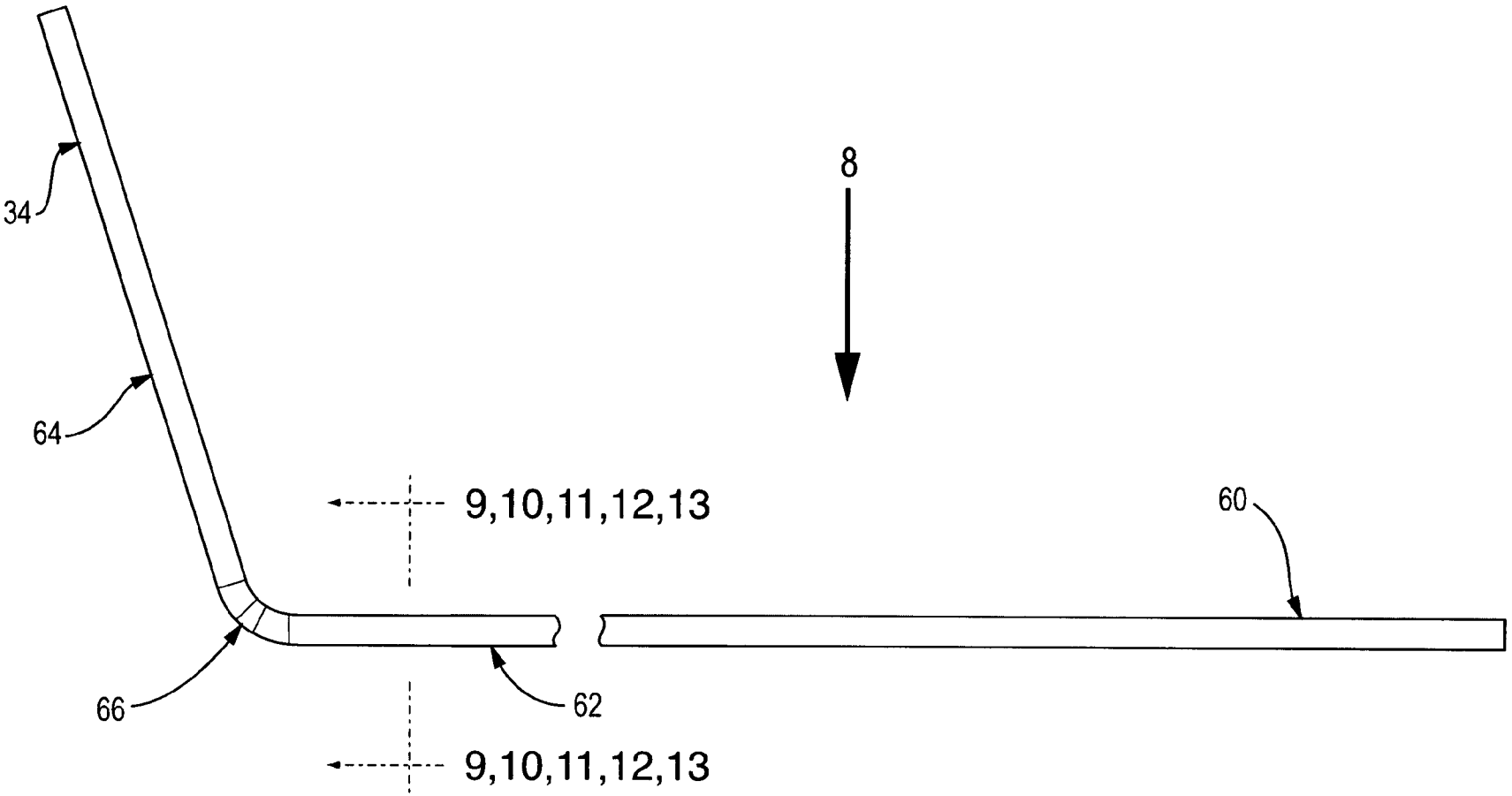
FIG. 7 is an enlarged diagrammatic side elevational view of the scraper arm of the strainer of the embodiments of the present invention identified by ARROW 7 in FIGS. 4-6.
Figure 8:
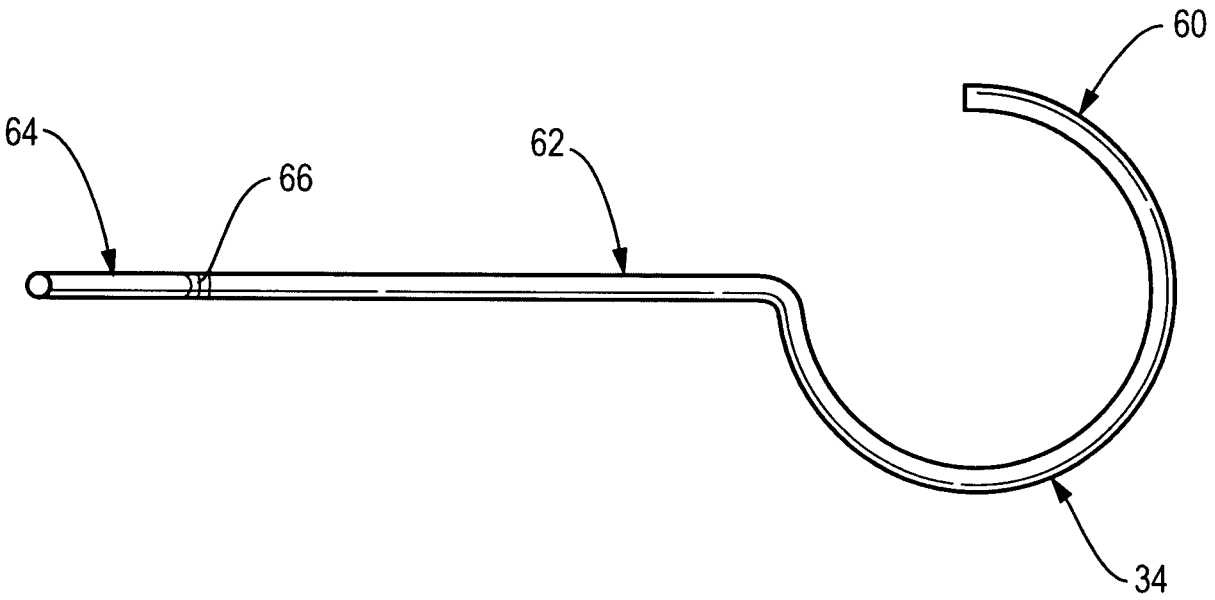
FIG. 8 is a reduced diagrammatic top plan view taken generally in the direction of ARROW 8 in FIG. 7.

The specific configuration of the scraper arm 34 can best be seen in FIGS. 4 and 7-13, which are, respectively, again an enlarged diagrammatic perspective view of the strainer of the embodiments of the present invention identified by ARROW 4 in FIGS. 1-3, an enlarged diagrammatic side elevational view of the scraper arm of the strainer of the embodiments of the present invention identified by ARROW 7 in FIGS. 4-6, a reduced diagrammatic top plan view taken generally in the direction of ARROW 8 in FIG. 7, an enlarged diagrammatic cross sectional view taken along LINE 9-9 in FIG. 7 of a first embodiment of the scraper arm of the strainer of the embodiments of the present invention, an enlarged diagrammatic cross sectional view taken along LINE 10-10 in FIG. 7 of a second embodiment of the scraper arm of the strainer of the embodiments of the present invention, an enlarged diagrammatic cross sectional view taken along LINE 11-11 in FIG. 7 of a third embodiment of the scraper arm of the strainer of the embodiments of the present invention, an enlarged diagrammatic cross sectional view taken along LINE 12-12 in FIG. 7 of a fourth embodiment of the scraper arm of the strainer of the embodiments of the present invention, and an enlarged diagrammatic cross sectional view taken along LINE 13-13 in FIG. 7 of a fifth embodiment of the scraper arm of the strainer of the embodiments of the present invention, and as such, will be discussed with reference thereto.

The scraper arm 34 comprises a proximal portion 60, an intermediate portion 62, and a distal portion 64.

The proximal portion 60 of the scraper arm 34 is thin, and circular-shaped to friction fit around the collar 42 of the handle 30 so as to rotate therewith when the internal recesses 52 in the collar 42 of the handle 30 cooperatively receive the splines 50 of the upper portion 44 of the stem 41 of the handle 30 and the stem 41 of the handle 30 is rotated by the user 27.

The intermediate portion 62 of the scraper arm 34 is slender, elongated, extends radially outwardly from the proximal portion 60 of the scraper arm 34, and sweeps along the floor 35 of the bowl 28 self-cleaning the residual solid debris 26 sticking to the floor 35 of the bowl 28 without a user 27 having to touch the residual solid debris 26, shake the strainer 20, or hit the strainer 20 against the object.

The distal portion 64 of the scraper arm 34 is slender, elongated, extends upwardly and outwardly, at a bend 66, from the intermediate portion 62 of the scraper arm 34, and sweeps along the circumferential side wall 36 of the bowl 28 self-cleaning the residual solid debris 26 sticking to the circumferential side wall 36 of the bowl 28 without a user 27 having to touch the residual solid debris 26, shake the strainer 20, or hit the strainer 20 against the object.

Figure 9:
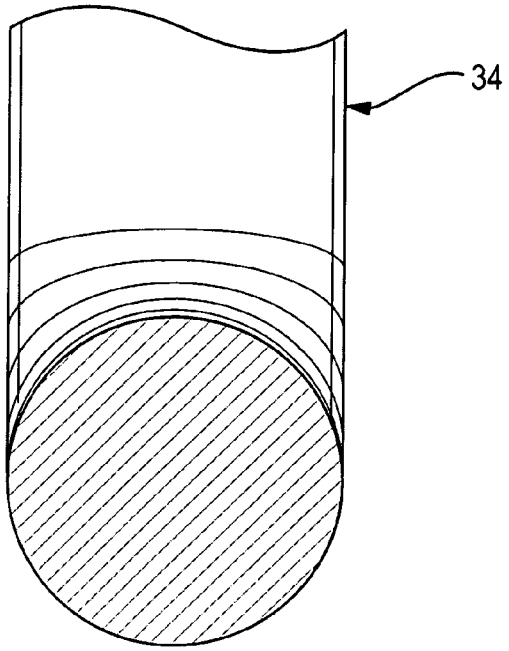
FIG. 9 is an enlarged diagrammatic cross sectional view taken along LINE 9-9 in FIG. 7 of a first embodiment of the scraper arm of the strainer of the embodiments of the present invention.

As shown in FIG. 9, the scraper arm 34 has a circular cross section.

Figure 10:
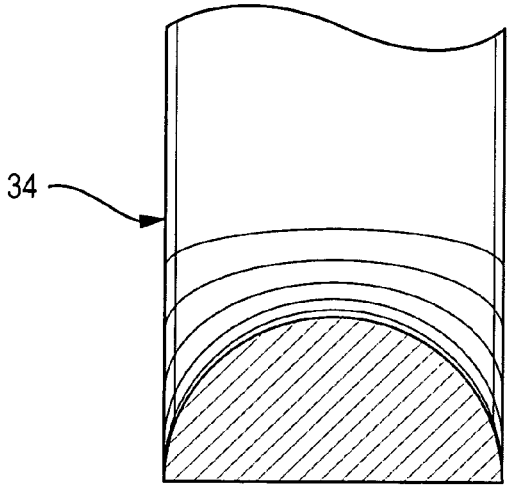
FIG. 10 is an enlarged diagrammatic cross sectional view taken along LINE 10-10 in FIG. 7 of a second embodiment of the scraper arm of the strainer of the embodiments of the present invention.

As shown in FIG. 10, the scraper arm 34 has a semi-circular cross section.

Figure 11:
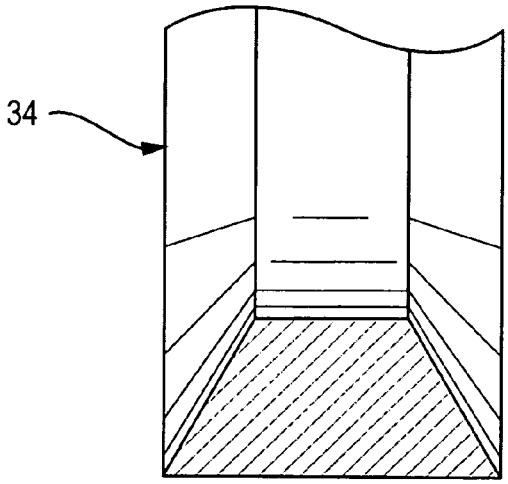
FIG. 11 is an enlarged diagrammatic cross sectional view taken along LINE 11-11 in FIG. 7 of a third embodiment of the scraper arm of the strainer of the embodiments of the present invention.

As shown in FIG. 11, the scraper arm 34 has a trapezoidal cross section.

Figure 12:
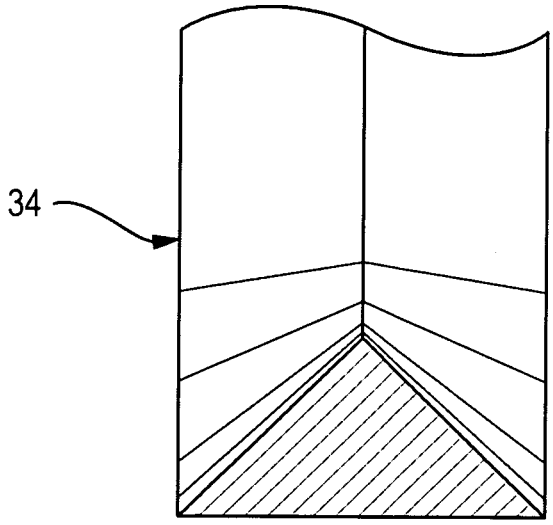
FIG. 12 is an enlarged diagrammatic cross sectional view taken along LINE 12-12 in FIG. 7 of a fourth embodiment of the scraper arm of the strainer of the embodiments of the present invention.

As shown in FIG. 12, the scraper arm 34 has a triangular cross section.

Figure 13:
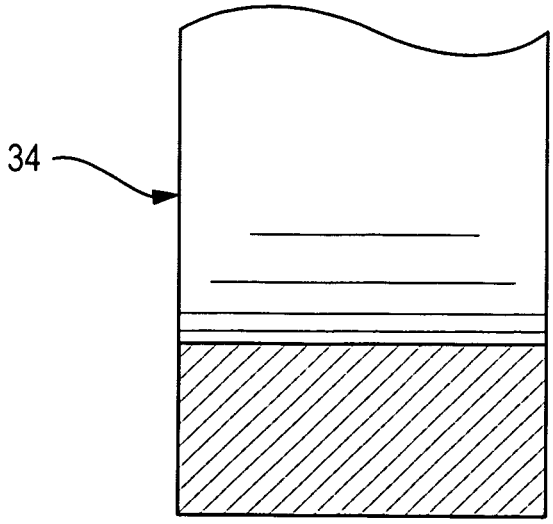
FIG. 13 is an enlarged diagrammatic cross sectional view taken along LINE 13-13 in FIG. 7 of a fifth embodiment of the scraper arm of the strainer of the embodiments of the present invention.

As shown in FIG. 13, the scraper arm 34 has a rectangular cross section.

F. Impressions.

It will be understood that each of the elements described above or two or more together may also find a useful application in other types of constructions differing from the types described above.

While the embodiments of the present invention have been illustrated and described as embodied in a strainer for fitting in a drain of a sink and for being self-cleaning of residual solid debris sticking to the strainer without a user having to touch the residual solid debris, shake the strainer, or hit the strainer against an object, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A strainer for fitting in a drain of a sink and for being self-cleaning of residual solid debris sticking to said strainer without a user having to touch the residual solid debris, shake said strainer, or hit said strainer against an object, said strainer comprising:

a) a bowl;

b) a handle;

c) a stopper; and d) a scraper arm;

wherein said bowl is for fitting snugly within the drain of the sink;

wherein said bowl is perforated for permitting fluid to pass therethrough, while collecting the residual solid debris;

wherein said handle is movably mounted through said bowl for manual removal of said strainer from the drain of the sink;

wherein said stopper is rotatably connected to said handle;

wherein said stopper is disposed below said bowl;

wherein said stopper is for sitting in the drain of the sink;

wherein said scraper arm is affixed to said handle;

wherein said scraper arm rotates with said handle; and wherein when said handle is rotated by hand manipulation, said scraper arm sweeps along said bowl self-cleaning the residual solid debris sticking to said bowl without the user having to touch the residual solid debris, shake the strainer, or hit the strainer against the object.

2. The strainer of claim 1, wherein said bowl is cylindrically shaped.

3. The strainer of claim 1, wherein said bowl has:

a) a floor;

b) a circumferential side wall; and c) a flange.

4. The strainer of claim 3, wherein said floor of said bowl is flat;

wherein said floor of said bowl is circular shaped;

wherein said floor of said bowl has a central through bore; and wherein said floor of said bowl is perforated for permitting fluid to pass therethrough, while collecting the residual solid debris.

5. The strainer of claim 3, wherein said circumferential side wall of said bowl extends divergently upwardly from said floor of said bowl to a terminal rim; and wherein said circumferential side wall of said bowl is perforated for permitting fluid to pass therethrough, while collecting the residual solid debris.

6. The strainer of claim 5, wherein said flange of said bowl extends radially outwardly from said terminal rim of said circumferential side wall of said bowl.

7. The strainer of claim 3, wherein said handle comprises:

a) a stem; and b) a collar.

8. The strainer of claim 7, wherein said collar of said handle is rotatably seated in said central through bore in said floor of said bowl.

9. The strainer of claim 8, wherein said stem of said handle is to said collar of said handle.

10. The strainer of claim 7, wherein said stem of said handle has:

a) an upper portion; and b) a lower portion.

11. The strainer of claim 10, wherein said upper portion of said stem of said handle is disposed above said floor of said bowl; and wherein said lower portion of said stem of said handle is disposed below said floor of said bowl.

12. The strainer of claim 10, wherein said upper portion of said stem of said handle has a crown; and wherein said crown of said upper portion of said stem of said handle is wider than said stem of said handle for facilitating gripping of said handle by the user.

13. The strainer of claim 10, wherein said upper portion of said stem of said handle has splines; and wherein said splines of said upper portion of said stem of said handle extend axially therealong.

14. The strainer of claim 13, wherein said collar of said handle contains internal recesses;

wherein said internal recesses in said collar of said handle extend axially therealong;

wherein said internal recesses in said collar of said handle selectively receive said splines of said upper portion of said stem of said handle; and wherein when said internal recesses in said collar of said handle cooperatively receive said splines of said upper portion of said stem of said handle, said collar of said handle rotates with said upper portion of said stem of said handle when said stem of said handle is rotated by the user.

15. The strainer of claim 1, wherein said stopper is truncated conically shaped; and wherein said stopper is made of rubber.

16. The strainer of claim 15, wherein said stopper has a central through bore; and wherein said central through bore in said stopper receives said lower portion of said stem of said handle.

17. The strainer of claim 10, wherein said lower portion of said stem of said handle terminates minimally past said stopper, at a pointed termination.

18. The strainer of claim 10, wherein said lower portion of said stem of said handle depends a distance below said stopper, at a thinned termination, for providing the user with a grip to rotate said handle.

19. The strainer of claim 7, wherein said scraper arm comprises:

a) a proximal portion;

b) an intermediate portion; and c) a distal portion.

20. The strainer of claim 19, wherein said proximal portion of said scraper arm is thin; and wherein said proximal portion of said scraper arm is circular-shaped to friction fit around said collar of said handle so as to rotate therewith when said internal recesses in said collar of said handle cooperatively receive said splines of said upper portion of said stem of said handle and said stem of said handle is rotated by the user.

21. The strainer of claim 19, wherein said intermediate portion of said scraper arm is slender;

wherein said intermediate portion of said scraper arm is elongated;

wherein said intermediate portion of said scraper arm extends radially outwardly from said proximal portion of said scraper arm; and wherein said intermediate portion of said scraper arm sweeps along said floor of said bowl self-cleaning the residual solid debris sticking to said floor of said bowl without the user having to touch the residual solid debris, shake said strainer, or hit said strainer against the object.

22. The strainer of claim 19, wherein said distal portion of said scraper arm is slender;

wherein said distal portion of said scraper arm is elongated;

wherein said distal portion of said scraper arm extends upwardly and outwardly, at a bend, from said intermediate portion of said scraper arm; and wherein said distal portion of said scraper arm sweeps along said circumferential side wall of said bowl self-cleaning said residual solid debris sticking to said circumferential side wall of said bowl without the user having to touch the residual solid debris, shake said strainer, or hit said strainer against the object.

23. The strainer of claim 1, wherein said scraper arm has a circular cross section.

24. The strainer of claim 1, wherein said scraper arm has a semi-circular cross section.

25. The strainer of claim 1, wherein said scraper arm has a trapezoidal cross section.

26. The strainer of claim 1, wherein said scraper arm has a triangular cross section.

27. The strainer of claim 1, wherein said scraper arm has a rectangular cross section.

28. An improved strainer for fitting in a drain of a sink, for being self-cleaning of residual solid debris, and being of the type having a bowl, a handle, and a stopper, wherein the bowl fits snugly within the drain of the sink, and is perforated to permit fluid to pass therethrough while collecting the residual solid debris, wherein the handle is movably mounted through the bowl to manually remove said improved strainer from the drain of the sink, wherein the stopper is rotatably connected to the handle, is disposed below the bowl, and sits in the drain of the sink, wherein said improvement comprises:

a) a scraper arm;

b) said scraper arm being affixed to the handle;

c) said scraper arm rotating with the handle; and d) said scraper arm sweeping along the bowl self-cleaning the residual solid debris sticking to the bowl without the user having to touch the residual solid debris, shake said improved strainer, or hit said improved strainer against the object, when the handle is rotated by hand manipulation.

29. The improved strainer of claim 28, wherein said improvement further comprises the bowl being cylindrically shaped.

30. The improved strainer of claim 28, wherein said improvement further comprises the bowl having:

a) a floor;

b) a circumferential side wall; and c) a flange.

31. The improved strainer of claim 30, wherein improvement further comprises the floor of the bowl:

a) being flat;

b) being circular shaped;

c) having a central through bore; and d) being perforated for permitting fluid to pass therethrough, while collecting the residual solid debris.

32. The improved strainer of claim 30, wherein said improvement further comprises the circumferential side wall of the bowl:

a) extending divergently upwardly from the floor of the bowl to a terminal rim; and b) being perforated for permitting fluid to pass therethrough, while collecting the residual solid debris.

33. The improved strainer of claim 32, wherein said improvement further comprises the flange of the bowl extending radially outwardly from the terminal rim of the circumferential side wall of the bowl.

34. The improved strainer of claim 30, wherein said improvement further comprises the handle comprising:

a) a stem; and b) a collar.

35. The improved strainer of claim 34, wherein said improvement further comprises the collar of the handle being rotatably seated in the central through bore in the floor of the bowl.

36. The improved strainer of claim 35, wherein said improvement further comprises the stem of the handle being operatively connected to the collar of the handle.

37. The improved strainer of claim 34, wherein said improvement further comprises the stem of the handle having:

a) an upper portion; and b) a lower portion.

38. The improved strainer of claim 37, wherein said improvement further comprises:

a) the upper portion of the stem of the handle being disposed above the floor of the bowl; and b) the lower portion of the stem of the handle being disposed below the floor of the bowl.

39. The improved strainer of claim 37, wherein said improvement further comprises:

a) the upper portion of the stem of the handle having a crown; and b) the crown of the upper portion of the stem of the handle being wider than the stem of the handle for facilitating gripping of said handle by the user.

40. The improved strainer of claim 37, wherein said improvement further comprises:

a) the upper portion of the stem of the handle having splines; and b) the splines of the upper portion of the stem of the handle extending axially therealong.

41. The improved strainer of claim 40, wherein said improvement further comprises:

a) the collar of the handle containing internal recesses;

b) the internal recesses in the collar of the handle extending axially therealong;

c) the internal recesses in the collar of the handle selectively receiving the splines of the upper portion of the stem of the handle; and d) when the internal recesses in the collar of the handle cooperatively receive the splines of the upper portion of the stem of the handle, the collar of the handle rotates with the upper portion of the stem of the handle when the stem of the handle is rotated by the user.

42. The improved strainer of claim 28, wherein said improvement further comprises the stopper:

a) being truncated conically shaped; and b) being made of rubber.

43. The improved strainer of claim 42, wherein said improvement further comprises:

a) the stopper having a central through bore; and b) the central through bore in the stopper receiving the lower portion of the stem of the handle.

44. The improved strainer of claim 37, wherein said improvement further comprises the lower portion of the stem of the handle terminating minimally past the stopper, at a pointed termination.

45. The improved strainer of claim 37, wherein said improvement further comprises the lower portion of the stem of the handle depending a distance below the stopper, at a thinned termination, for providing the user with a grip to rotate the handle.

46. The improved strainer of claim 34, wherein said improvement further comprises said scraper arm comprising:

a) a proximal portion;

b) an intermediate portion; and c) a distal portion.

47. The improved strainer of claim 46, wherein said improvement further comprises said proximal portion of said scraper arm:

a) being thin; and b) being circular-shaped to friction fit around the collar of the handle so as to rotate therewith when the internal recesses in the collar of the handle cooperatively receive the splines of the upper portion of the stem of the handle and the stem of the handle is rotated by the user.

48. The improved strainer of claim 46, wherein said improvement further comprises said intermediate portion of said scraper arm:

a) being slender;

b) being elongated;

c) extending radially outwardly from said proximal portion of said scraper arm; and d) sweeping along the floor of the bowl self-cleaning the residual solid debris sticking to the floor of the bowl without the user having to touch the residual solid debris, shake said improved strainer, or hit said improved strainer against the object.

49. The improved strainer of claim 46, wherein said improvement further comprises said distal portion of said scraper arm:

a) being slender;

b) being elongated;

c) extending upwardly and outwardly, at a bend, from said intermediate portion of said scraper arm; and d) sweeping along the circumferential side wall of the bowl self-cleaning the residual solid debris sticking to the circumferential side wall of the bowl without the user having to touch the residual solid debris, shake said improved strainer, or hit said improved strainer against the object.

50. The improved strainer of claim 28, wherein said improvement further comprises said scraper arm having a circular cross section.

51. The improved strainer of claim 28, wherein said improvement further comprises said scraper arm having a semi-circular cross section.

52. The improved strainer of claim 28, wherein said improvement further comprises said scraper arm having a trapezoidal cross section.

53. The improved strainer of claim 28, wherein said improvement further comprises said scraper arm having a triangular cross section.

54. The improved strainer of claim 28, wherein said improvement further comprises said scraper arm having a rectangular cross section.

* * * * *